US006343656B1

(12) United States Patent
Vazquez et al.

(10) Patent No.: US 6,343,656 B1
(45) Date of Patent: Feb. 5, 2002

(54) SYSTEM AND METHOD FOR OPTIMIZING PRODUCTION FROM A ROD-PUMPING SYSTEM

(75) Inventors: Manuel Vazquez; Jose Fernandes, both of Caracas (VE)

(73) Assignee: Intevep, S.A., Caracas (VE)

( * ) Notice: Subject to any disclaimer, the term of this patent is extended or adjusted under 35 U.S.C. 154(b) by 0 days.

(21) Appl. No.: 09/534,904

(22) Filed: Mar. 23, 2000

(51) Int. Cl.[7] ..... E21B 34/06

(52) U.S. Cl. ..... 166/373; 166/64; 166/54.1; 166/53; 73/861.43; 375/214; 346/33 R

(58) Field of Search ..... 166/53, 54.1, 64, 166/244.1, 373; 346/33 R; 73/861.43; 375/214

(56) References Cited

U.S. PATENT DOCUMENTS

| | | | | |
|---|---|---|---|---|
| 3,610,779 | A | | 10/1971 | Hubby |
| 3,938,910 | A | | 2/1976 | Douglas |
| 4,102,394 | A | | 7/1978 | Botts |
| 4,228,509 | A | | 10/1980 | Kennedy |
| 4,358,822 | A | | 11/1982 | Sanchez |
| 4,483,188 | A | * | 11/1984 | McTamaney et al. |
| 4,490,094 | A | | 12/1984 | Gibbs |
| 4,541,274 | A | * | 9/1985 | Purcupile |
| 4,551,730 | A | * | 11/1985 | McTamaney et al. |
| 4,594,665 | A | | 6/1986 | Chandra et al. |
| 4,622,635 | A | * | 11/1986 | Chandra et al. |
| 4,749,925 | A | | 6/1988 | Wilkins |
| 4,767,280 | A | | 8/1988 | Markuson et al. |
| 4,975,069 | A | | 12/1990 | Fedder et al. |
| 5,015,151 | A | | 5/1991 | Snyder, Jr. et al. |
| 5,023,912 | A | | 6/1991 | Segawa |
| 5,159,977 | A | | 11/1992 | Zabras |
| 5,222,867 | A | | 6/1993 | Walker, Sr. et al. |
| 5,251,131 | A | | 10/1993 | Masand et al. |
| 5,339,257 | A | | 8/1994 | Layden et al. |
| 5,580,221 | A | | 12/1996 | Triezenberg |
| 5,703,964 | A | | 12/1997 | Menon et al. |

* cited by examiner

*Primary Examiner*—Roger Schoeppel
(74) *Attorney, Agent, or Firm*—Bachman & LaPointe, P.C.

(57) ABSTRACT

A method for optimizing production from a rod-pumping system includes the steps of providing a well having a rod-pumping system for pumping a fluid from a downhole location of the well to a surface location of the well; providing a mathematical model for determining a dynagraph relationship for the well from power consumption of the rod pumping system; measuring power consumption per cycle of the rod pumping system; determining a downhole dynagraph relationship from the power consumption per cycle and the model; measuring real time values of wellhead pressure and preferably wellhead temperature; and determining an optimum operating condition for the rod-pumping system from the downhole dynagraph relationship and the real time values.

20 Claims, 3 Drawing Sheets

SYSTEM AND METHOD FOR OPTIMIZING PRODUCTION FROM A ROD-PUMPING SYSTEM

BACKGROUND OF THE INVENTION

The invention relates to a system and method for optimizing production from a rod-pumping system.

Rod-pumping systems such as sucker-rod type pumping units and the like are widely used in the petroleum industry in order to assist in recovering fluid from wells extending into subterranean formations containing such fluid. A typical sucker-rod unit includes a sucker-rod string which extends into the well and a motor or other structure at the surface for generating an up and down movement of the rod string in order to operate a downhole pump.

A variety of malfunctions can occur with such systems, including worn pumps, broken sucker-rods, split tubing, stuck valves and the like. These malfunctions can be caused by normal wear and tear, and can be accelerated and/or exacerbated by abnormal pumping conditions.

A useful tool in evaluating the operating state of a rod-pumping system is the dynagraph chart, which is the rod load as a function of position of the rod string. Dynagraph charts are typically obtained using load and position cells, but three main problems arise using this technology. First, the load cell calibration procedure is difficult and must be done frequently. Second, temperature adjustments must be carried out. Third, great care must be taken with the electronic devices each time field work is necessary. Due to these problems, obtaining dynagraph charts has been limited to only certain wells where production benefits justify these difficulties.

It is the primary object of the present invention to provide a system and method whereby dynagraph relationships can be widely used to optimize and enhance production from rod-pumping systems without the aforesaid difficulties.

It is a further object of the present invention to provide such a method and system which can detect potential fault conditions before they occur so that production interruptions and excessive equipment wear can be avoided.

Other objects and advantages of the present invention will appear hereinbelow.

SUMMARY OF THE INVENTION

In accordance with the present invention, the foregoing objects and advantages have been readily attained.

According to the invention, a method is provided for optimizing production from a rod-pumping system, which method comprises the steps of providing a well having a rod pumping system for pumping a fluid from a downhole location of said well to a surface location of said well; providing a mathematical model for determining a dynagraph relationship for said well from power consumption of said rod-pumping system; measuring power consumption per cycle of said rod pumping system; determining a downhole dynagraph relationship from said power consumption per cycle and said model; measuring real time values of wellhead pressure; and determining an optimum operating condition for said rod pumping system from said downhole dynagraph relationship and said real time values.

In further accordance with the present invention, a system has been provided for optimizing operation of a rod pumping system in a well for pumping fluid from a downhole location of said well to a surface location of said well, comprising: a power sensor for measuring instantaneous power consumption of said rod-pumping system; a pressure sensor for measuring real time wellhead pressure of said well; and control unit communicated with said power sensor and said pressure sensor and programmed with a mathematical model for determining a dynagraph relationship for said well from power consumption of said rod pumping system per cycle, said control unit being adapted to: determine a downhole dynagraph relationship from said power consumption per cycle and said model; and determine an optimum operating condition for said rod pumping system from said downhole dynagraph relationship and said real time wellhead pressure; whereby optimum operating conditions are determined from dynagraph relationships without directly measuring said dynagraph relationships.

BRIEF DESCRIPTION OF THE DRAWINGS

A detailed description of preferred embodiments of the present invention follows, with reference to the attached drawings wherein.

DETAILED DESCRIPTION

The invention relates to a system and method for optimizing production from a well using a rod-pumping system and, more particularly, to a system and method for optimizing the rod-pumping conditions.

Figure 1:
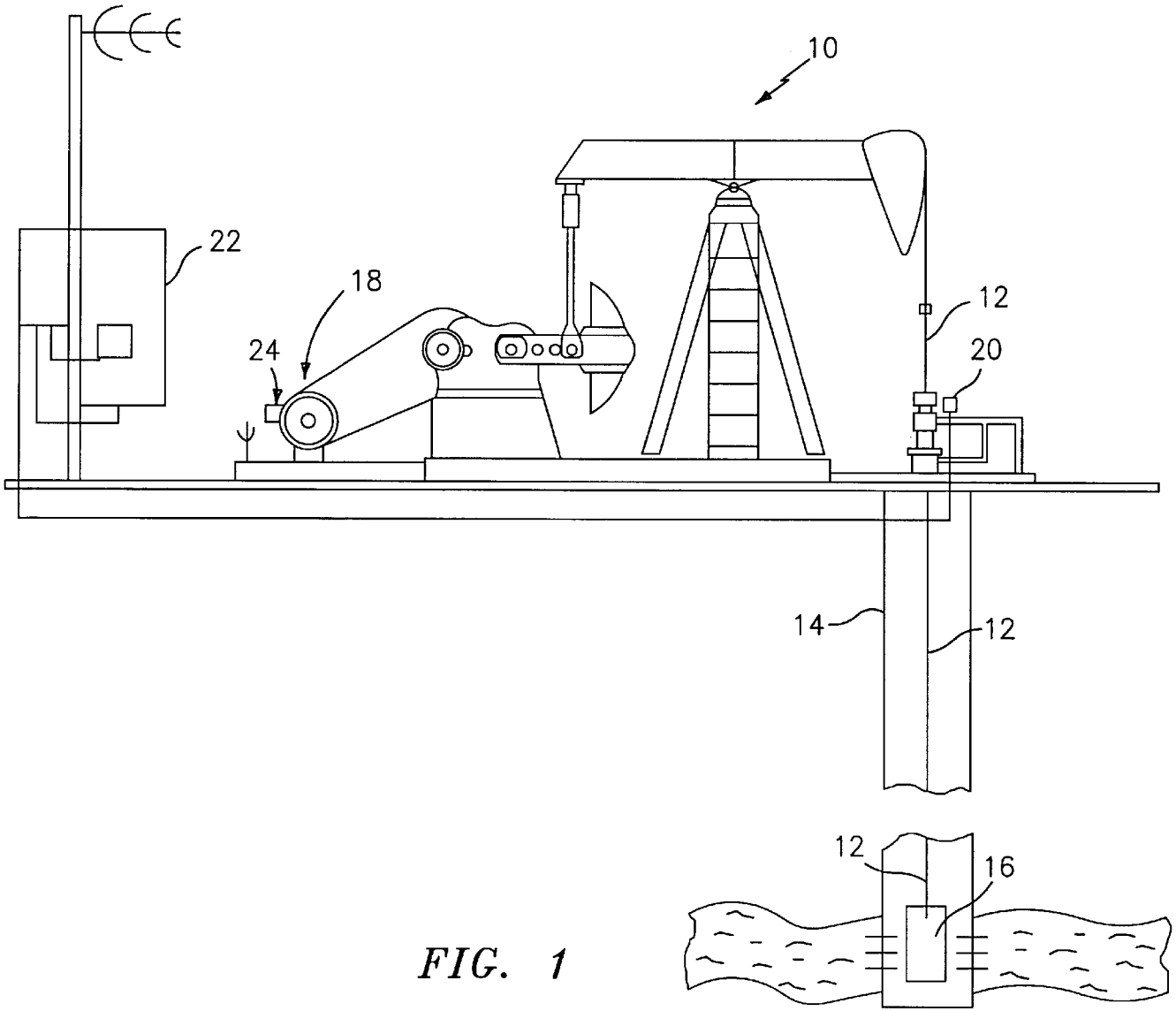
FIG. 1 is a schematic illustration of a system in accordance with the present invention.

FIG. 1 shows a typical rod-pumping unit 10 which may include a rod string 12 disposed through a subterranean well 14 to a pump unit 16 positioned downhole for enhancing flow of fluid up through well 14 to the surface as desired.

String 12 is moved up and down within well 14 by a typical motor or other drive unit 18 in order to drive pump 16 and cause such flow as is well know in the art.

The present invention relates to a system and method for optimizing production using unit 10 by optimizing operating conditions or parameters thereof, particularly, the speed of motor 18.

Unit 10 preferably includes a sensor unit 20 including a pressure sensor for sensing real time values of wellhead pressure of well 14, and preferably including a temperature sensor for sensing real time values of wellhead temperature of fluids being produced from well 14. Sensor unit 20 is preferably operatively associated with a control unit 22 for providing real time information or values related to wellhead pressure and temperature to control unit 22 for purposes which will be discussed below.

Unit 10 in accordance with the present invention also includes a sensor 24 or other device for determining the current power consumption of motor 18, and sensor 24 is also preferably communicated with control unit 22 so as to continuously provide instantaneous information or values of power consumption to control unit 22.

In accordance with the present invention, operation of the rod-pumping unit 10 is optimized by inferring surface and downhole dynagraph charts, curves or relationships from the power consumption information obtained by control unit 22, and then by evaluating and predicting optimum unit operating parameters from the dynagraph relationships and real time values of wellhead pressure and temperature.

Conventionally, dynagraph charts or relationships are useful tools for controlling such systems. However, this information is conventionally obtained utilizing a series of direct sensors such as load sensors and position sensors which, as set forth above, cause a number of difficulties and problems. In the present invention, the dynagraph relationships or charts are inferred from power consumption per cycle information utilizing a mathematical model of such power consumption per cycle generated for that well, and the inferred dynagraph relationships are then advantageously utilized to determine optimum motor or pump speed for a unit 10 in well 14. Optimum motor or pump speed is preferably inferred by applying the dynagraph relationship information to a fuzzy logic control and/or a pattern recognition system, preferably both. The fuzzy logic controller may be a knowledge base storing at least one rule, preferably a plurality of rules, which are applied to guide the decision as to optimum operating conditions. A pattern recognition system may be provided as a neural network for identifying possible pumping faults or other conditions justifying a change in speed.

This method advantageously avoids the need for multiple sensors for measuring dynagraph relationships, which sensors are difficult to maintain, and which are conventionally necessary for directly measuring dynagraph relationships.

Figure 2:
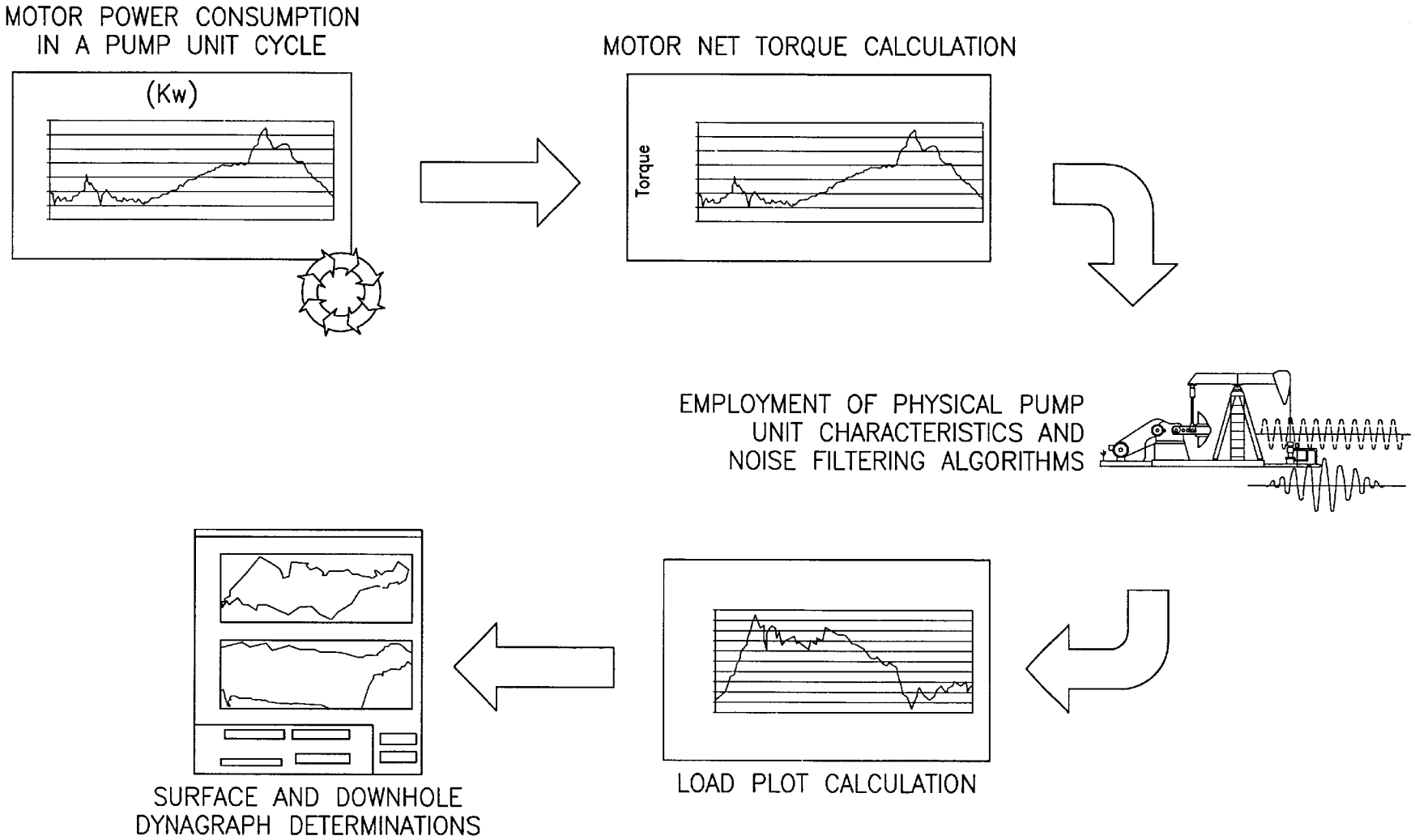
FIG. 2 schematically illustrates a method in accordance with the present invention.

Referring now to FIG. 2, the method for obtaining surface and downhole dynagraph relationships or charts directly from motor power consumption per unit cycle is illustrated in accordance with the present invention.

As shown, motor power consumption in a pump unit cycle is continuously monitored and measured and fed to control unit 22 so as to provide a relationship of power in kilowatts per pump cycle or stroke. From this information, the motor net torque per cycle of motor 18 and eventually dynagraph relationship information can be determined as this value is proportional to the power consumption.

In accordance with the present invention, a mathematical model is constructed and programmed into control unit 22, and this model is utilized to determine the desired dynagraph charts from power consumption. This model employs physical pump unit characteristics such as the pump geometric configuration and the like, and also utilizes noise filtering algorithms such as low band noise filters to correct for factors such as electrical interference and discontinuities and the like. The mathematical model is as follows.

Instantaneous net torque can be calculated from instantaneous net power consumption using the following formulas:

$$Tn=(84.5*P*Eff)/(SPM*sv) \text{ if power is higher than zero}$$

$$Tn=(132.04*P*Eff)/(SPM*sv) \text{ if power is lower than zero,} \quad (1)$$

wherein:

Tn=net torque;

P=instantaneous power in Kilowatts;

Eff=motor/reducer efficiency, typically 0.8;

sv=Minimum velocity/average velocity, typically 0.9; and

SPM=Unit strokes per minutes.

Since each point in the instantaneous net power consumption graph is acquired in 0.05 seconds interval, this SPM value can be calculated from the total number of points that are in the whole power consumption cycle:

$$SPM=60 \text{ sec}/(0.05 \text{ sec}*\#\text{points}) \quad (2)$$

From equation (1) it is deduced that net torque depends directly from power consumption:

$$Tn=f(P;k) \text{ where k is a constant.} \quad (3)$$

Also, net torque is the difference between the well's produced torque and counterweight's produced torque for each crank angle:

$$Tn(\theta)=Tp(\theta)-Tm(\theta), \quad (4)$$

wherein:

Tp=well torque;

Tm=counterweight torque; and

θ=crank angle for each point;

Each of the torques are expressed from the following functions:

$$Tp(\theta)=FT(\theta)*(L(\theta)-SU), \quad (5)$$

and $$Tm(\theta)=M*\sin(\theta=\sigma), \quad (6)$$

wherein:

FT=unit torque factor, which depends on the crank angle and is calculated through the unit geometry using standard calculations;

L=polished rod load, also depends on crank angle;

SU=unit structure unbalance obtained from system literature;

M=maximum unit counterweight momentum given by weights; and

σ=unit phase angle obtained from system literature.

Polished rod load can be obtained from equations 4, 5 and 6 as follows:

$$L(\theta)=(Tn(\theta)=M*\sin(\theta+\sigma))/FT(\theta)+SU. \quad (7)$$

Therefore, load is a function that depends on power consumption, crank angle and a maximum counterweight momentum:

$$L=f(P, \theta, M;k). \quad (8)$$

Since the power consumption signal can be affected by electrical interference and some discontinuities may be present in the calculations (such as time acquisition slips for example), a low band noise filter is applied to obtain the polished rod load as close as possible to actual values.

The polished rod displacement, also necessary to obtain the dynagraph relationship, is directly obtained using the known unit geometry for each crank angle position.

Still referring to FIG. 2, the mathematical model is used in accordance with the present invention to provide a load plot calculation from the specific power consumption per unit cycle, and this load plot calculation is a plot or relationship between load on the pump unit and the unit cycle or stroke position, which is the basis for the surface dynagraph relationship. From this measurement, as shown in FIG. 2, a surface dynagraph chart can be prepared or inferred which, as is well known in the art, is a plot of load on the pump unit from beginning of an upward stroke of string 12 to the end of an upward stroke of string 12, and then back in a downward stroke to the starting point. Once the surface dynagraph chart or relationship has been prepared, a downhole dynagraph relationship can be obtained utilizing a wave equation model as identified by Gibbs, S. G.: "Predicting the Behavior of a Sucker Rod Pumping System," SPE of AIME, paper No. 588, Denver, Colo., (May 1963) and Brown K.E.: "The Technology of Artificial Lift Method" Pennwell Publishing Company, Tulsa, Okla.; see also U.S. Pat. No.

4,490,094 to Gibbs. The downhole relationship is typically presented as the load above plunger vs. plunger position.

The calculations for determining each step along the schematic representation of FIG. 2 are preferably all carried out by control unit 22 utilizing command and data information programmed and stored therein and real time data obtained from sensors 20, 24. Once the surface and downhole dynagraph charts are obtained, the optimum motor speed can be determined from the dynagraph charts and real time values of wellhead pressure and temperature, preferably utilizing fuzzy logic controller including a plurality of rules forming a knowledge base, and a pattern recognition unit such as a trained neural network.

Figure 3:
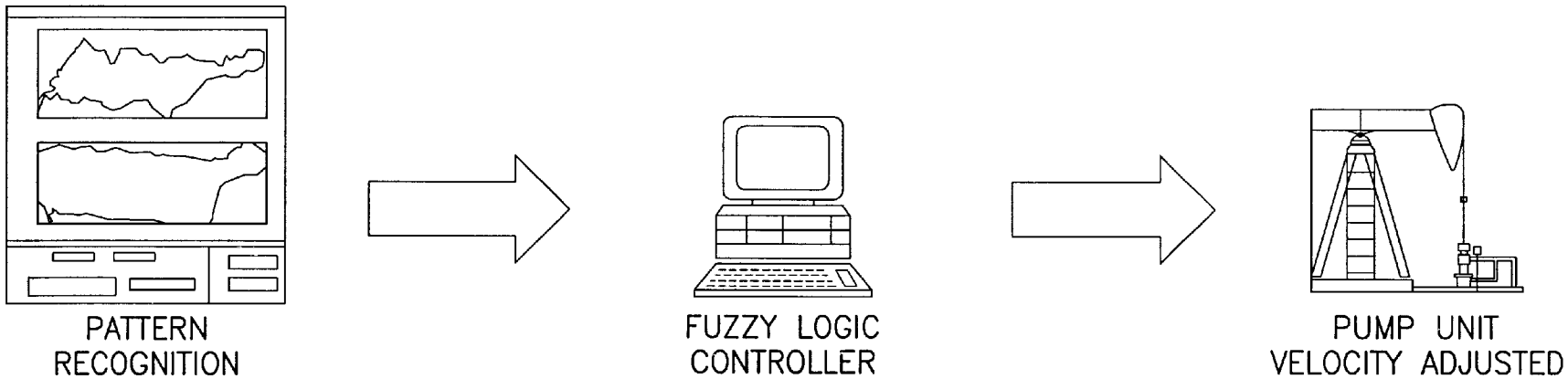
FIG. 3 schematically illustrates further steps and features of the present invention.

FIG. 3 schematically shows a pattern recognition step where the dynagraph relationship obtained in FIG. 2 is compared to previously identified data to determine whether a match with a known fault condition is detected. If a match is detected, an optimum operating condition selected to avoid pump damage and shut downs can be identified. Resulting information is preferably also passed to a fuzzy logic controller as shown, which utilizes the dynagraph relationship, real time temperature and pressure values, input from the pattern recognition system and the rules of the knowledge base to determine an optimum operating condition.

The system and method may advantageously evaluate the optimum operating condition to predict whether results will be favorable, and conduct further analysis if the selected optimum operating condition does not pass evaluation.

In the event that the optimum operating condition evaluates favorably, the new setting may be carried out manually or may be automatically conveyed to an operating condition controller such as a variable speed driver to operate at the new setting.

Using the system and method of the present invention, it is possible to analyze and diagnose the state of a well in operation and to issue a recommendation or command to bring about a desired field action. This action may typically be the well pump speed, for example in strokes per minute. This can be provided as a recommendation to an operator who would then manually enter the recommended speed if acceptable. Alternatively, and preferably, unit 10 may be a closed loop system so that the control action can automatically be executed by unit 10 on the system of the present invention so as to automatically adjust motor 18 to run at the desired pumping speed. Variable speed drivers are well known to a person of ordinary skill in the art and could readily be used to accomplish these adjustments.

As set forth above, the inferred dynagraph relationships and real time values of wellhead pressure and temperature are preferably evaluated according to the invention utilizing a knowledge base and pattern recognition system so as to arrive at a recommended action for operating speed, if necessary.

The knowledge base forms or is part of a fuzzy logic controller which contains a plurality of rules which are processed using multi evaluated logic that allow intermediate values to be determined and used to define, in more detail, conventional evaluations such as "yes/no", "true/false", etc.

For example, the knowledge base may contain a plurality of rules which use input such as downhole pump fault conditions, casing pressure, tubing pressure, wellhead temperature, diluent injection valve aperture, rod-pumping unit velocity and well completion factors to control a process.

The output or set point from the fuzzy is variable and is regulated automatically in accordance with the present invention for pump unit operational speed and diluent valve percentage of aperture. A user interface is preferably provided which allows visualizing changes in the set points as well as the method used to make certain decisions. The system may be programmed to evaluate and make decisions on a periodic basis, for example, every ten minutes.

One embodiment of the present invention involves a system which includes several modules for performing various tasks as outlined above.

One module may be constructed as a surface dynagraph chart acquisition module, which decodes surface dynagraph chart information if necessary into load and displacement values, and stores them into dynamic structures more useful with the remainder of the system.

Another module is constructed for reading physical characteristics of the well, and this module reads the static well characteristics only when the system is started for the first time. These static wells characteristics are used to help calculate the downhole dynagraph relationship using the wave equation model as discussed above.

A downhole dynagraph chart calculation module is also preferably provided. This module obtains a downhole dynagraph chart using well completion information and the surface dynagraph relationship information. The downhole dynagraph chart or relation may suitably be conditioned before use by the fuzzy logic controller, which evaluates rules contained in the knowledge base. Output may then be fed to neural networks for pattern recognition, and the particular chart or relationship is classified into a particular type of pattern such as fluid pound, gas interference, traveling valve leak, standing valve leak, viscous fluid, full pump, worn out pump, parted rods and the like. These are all various conditions which may dictate change in operating parameters in accordance with the present invention.

A further module is preferably provided for obtaining all field measurements. Specifically, as discussed above, dynamic field variables to measure include rod-pump unit velocity (SPM), casing pressure, tubing pressure, wellhead temperature, diluent injection valve aperture if desired, and the like.

Still another module is provided for storing and utilizing the knowledge base and fuzzy inference controller or motor. In preparation, this module is loaded with the knowledge base, and just the system is started. The rules are written in a language understandable by the expert, and the system reads and stores these rules in dynamic data structures.

An input data fuzzification module transforms all variables into fuzzy values having a certainty degree between zero (totally false) and one (totally true), based upon the certainty function for each variable. Rules are then evaluated so as to provide each with the minimum certainty value using logic AND operators so as to assign the minimum value of the rule. For example a rule utilizing a low tubing pressure value having a certainty of 0.1, and low temperature value having a certainty of 0.7 could be utilized to provide an increased speed value which would be assigned the lowest or minimum certainty value of 0.1.

An output data defuzzification module is also preferably provided which receives a plurality of action recommendations from the fuzzy logic controller and obtains only a single value for the new pump unit speed and, if desired, diluent value aperture. The selection of a single action from the plurality of actions may be made utilizing the Mandani or gravity center methods. The output attributes are preferably provided to a controller of the system so as to increase or decrease speed or other parameters gradually, rather than to effect any sudden changes which could themselves cause system oscillations or other problems.

Finally, a command execution module is preferably provided in the system of the present invention and may be designed as a closed loop control which executes the recommended action on the particular well equipment in question. In this way, complete automization of the system can be accomplished.

As set forth above, neural networks are applied to identify and/or diagnose the downhole dynagraph chart patterns and to identify possible failures in the downhole pump. The neural network would of course need to be initially trained to a point of reasonable accuracy using well known techniques.

In accordance with the foregoing, it should be readily appreciated that the system and method of the present invention advantageously provide for optimizing the operation of a rod-pumping system using the dynagraph relationships available, but without the disadvantages characteristically present with direct measurement of these parameters. This is accomplished by inferring the dynagraph relationships from power consumption information obtained from the motor, and without any direct measurement of the dynagraph relationship.

The system and method of the present invention further advantageously allow for prediction of rod-pumping and well behavior before actual events occur due to pattern recognition as discussed above. Through this prediction, events which could normally lead to well shutdown can be addressed by reducing pump or motor speed so as to potentially avoid a shutdown all together.

The dynagraph charts allow for fault and production variation diagnosis which can be carried out by the control unit. For example, insufficient oil production could be detected through dynagraph chart analysis and lead to a reduction in pump unit velocity, for example by a percentage selected to allow additional fluid to enter the pumping zone between strokes, so as to keep the well in constant production while reducing unnecessary electrical consumption and unnecessary wear on the pumping equipment. The constant well production is particularly advantageous when it is considered that insufficient oil production, if not adjusted for, could lead to mechanical failures and the need for a complete stopping of the motor and pump of the rod-pumping system to allow for repairs.

Control unit 22 may suitably be provided as any processor capable of storing and executing the desired data and programming, such as a typical personal computer, workstation, and the like.

Control unit 22 may suitably be programmed or tested to operate a well at desirably broad ranges of expected values such as fluid API gravity of between about 12 and about 35 degrees, fluid water content of between about 1% vol. and about 80% vol., and a gas oil ratio of between about 50 scf/stb and about 900 scf/stb, where the system has been tested. This identifies, if desired, the operating conditions on which the system has been tested. Of course, the system may operate outside these tested ranges. Further, wide ranges of variables can be tested for depending upon the type of conditions expected at a particular well instillation.

It should be noted that the dynagraph relationship is referred to herein at some points as a dynagraph chart. Although this is the customary form for presenting such information, it is well within the scope of the present invention for the system and method to operate without actually constructing a chart or plot of the data.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for optimizing production from a rod-pumping system, comprising the steps of:

providing a well having a rod-pumping system for pumping a fluid from a downhole location of said well to a surface location of said well;

providing a mathematical model for determining a dynagraph relationship for said well from power consumption of said rod pumping system;

measuring power consumption per cycle of said rod pumping system;

determining a downhole dynagraph relationship from said power consumption per cycle and said model;

measuring real time values of wellhead pressure; and determining an optimum operating condition for said rod-pumping system from said downhole dynagraph relationship and said real time values.

2. A method according to claim 1, wherein said rod-pumping system includes a motor, and wherein said optimum operating condition is optimum operating speed of said motor.

3. A method according to claim 1, wherein said step of determining said downhole dynagraph relationship comprises determining a surface dynagraph relationship from said model and applying a wave equation model to said surface dynagraph relationship so as to determine said downhole dynagraph relationship.

4. A method according to claim 3, wherein the step of determining said surface dynagraph relationship comprises determining net torque per cycle of said rod-pumping system from said power consumption per cycle and determining said surface dynagraph relationship from said net torque per cycle.

5. A method according to claim 1, wherein said mathematical model is constructed for well operating conditions including fluid API gravity of between about 12 and about 35 degrees, fluid water content of between about 1% vol. and about 80% vol., and a gas oil ratio of between about 50 scf/stb and about 900 scf/stb.

6. A method according to claim 1, wherein said step of measuring real time values further includes measuring a real time value of wellhead temperature of said well.

7. A method according to claim 1, wherein said step of determining said optimum operating condition includes detecting fault prediction conditions, and wherein said optimum operating condition is a pumping speed selected to correct for said fault prediction conditions whereby rod pumping system shut downs can be prevented.

8. A method according to claim 1, further comprising the step of providing a neural network trained to recognize patterns of said dynagraph relationship corresponding to fault prediction conditions.

9. A method according to claim 1, further comprising the steps of providing a fuzzy logic controller having a knowledge base including at least one decision guiding rule, and applying said real time values to said fuzzy logic controller so as to select said optimum operating condition.

10. A method according to claim 1, further comprising the step of evaluating predicted results from said optimum operating condition so as to either validate or reject said optimum operating condition, and determining a new optimum operating condition when said optimum operating condition is rejected.

11. A method according to claim 10, wherein said rod-pumping system further includes an operating condition controller, and further comprising the step of sending validated optimum operating conditions to said operating condition controller.

12. A system for optimizing operation of a rod pumping system in a well for pumping fluid from a downhole location of said well to a surface location of said well, comprising:

a power sensor for measuring instantaneous power consumption of said rod-pumping system;

a pressure sensor for measuring real time wellhead pressure of said well; and a control unit communicated with said power sensor and said pressure sensor and programmed with a mathematical model for determining a dynagraph relationship for said well from power consumption of said rod pumping system per cycle, said control unit being adapted to:

determine a downhole dynagraph relationship from said power consumption per cycle and said model; and determine an optimum operating condition for said rod pumping system from said downhole dynagraph relationship and said real time wellhead pressure;

whereby optimum operating conditions are determined from dynagraph relationships without directly measuring said dynagraph relationships.

13. A system according to claim 12, wherein said rod-pumping system includes a motor, and wherein said optimum operating condition is optimum operating speed of said motor.

14. A system according to claim 12, wherein said control unit is further adapted to determine a surface dynagraph relationship from said model and to apply a wave equation model to said surface dynagraph relationship so as to determine said downhole dynagraph relationship.

15. A system according to claim 14, wherein said control unit is further adapted to determine a net torque per cycle of said rod-pumping system from said power consumption per cycle and to determine said surface dynagraph relationship from said net torque per cycle.

16. A system according to claim 12, wherein said mathematical model is constructed for well operating conditions including fluid API gravity of between about 12 and about 35 degrees, fluid water content of between about 1% vol. and about 80% vol., and a gas oil ratio of between about 50 scf/stb and about 900 scf/stb.

17. A system according to claim 12, further comprising a temperature sensor for sensing real time wellhead temperature of said well, said control unit being communicated with said temperature sensor and being adapted to determine said optimum operating condition from said downhole dynagraph relationship, said real time wellhead pressure and said real time wellhead temperature.

18. A system according to claim 12, wherein said control unit further includes a neural network trained to recognize patterns of said downhole dynagraph relationship corresponding to fault prediction conditions.

19. A system according to claim 12, wherein said control unit further comprises a fuzzy logic controller having a knowledge base including at least one decision guiding rule, said control unit being adapted to utilize at least one of said real time wellhead pressure, said real time power consumption per cycle, and combinations thereof, and said fuzzy logic controller, so as to select said optimum operating condition.

20. A system according to claim 12, further comprising an operating condition controller, said control unit being operatively associated with said operating condition controller for automatically setting said rod pumping system at said optimum operating condition.

* * * * *